United States Patent [19]

Loix

[11] 4,053,028

[45] Oct. 11, 1977

[54] APPARATUS SUITABLE FOR USE AS STAIRWAYS, STEPLADDERS AND THE LIKE

[76] Inventor: Gilbert Loix, Chaussee Brunehault 22, 4462 Wihogne, Belgium

[21] Appl. No.: 689,823

[22] Filed: May 25, 1976

[30] Foreign Application Priority Data

May 26, 1975 Belgium ..... 829490
Apr. 15, 1976 Belgium ..... 0166178

[51] Int. Cl.[2] ..... E06C 1/393; E06C 1/397

[52] U.S. Cl. ..... 182/1; 182/16; 182/28; 182/129

[58] Field of Search ..... 182/1, 129, 96, 125, 182/20, 21, 28, 27, 33, 16

[56] References Cited

U.S. PATENT DOCUMENTS

| | | | |
|---|---|---|---|
| 1,419,834 | 6/1922 | Fellows | 182/1 |
| 1,945,531 | 2/1934 | Kramer | 182/1 |
| 2,865,546 | 12/1958 | Shull | 182/125 |
| 2,978,062 | 4/1961 | DiCamillo | 182/1 |
| 3,104,889 | 9/1963 | Branch | 182/20 |
| 3,954,155 | 5/1976 | Guidara | 182/20 |
| 3,961,809 | 6/1976 | Clugston | 182/96 |

*Primary Examiner*—Reinaldo P. Machado
*Attorney, Agent, or Firm*—Robert E. Burns; Emmanuel J. Lobato; Bruce L. Adams

[57] ABSTRACT

Apparatus for use as a stairway, stepladder and the like has a pair of upper stringers and a pair of lower stringers, all connected at one end to a top structure; and a series of treads, each of which is pivoted to the upper and lower stringers. The axes of articulation associated with the upper stringers are offset vertically from those associated with the lower stringers so that the stringers may be swung about their points of connection with the top structure, without the treads deviating from the horizontal into a horizontal position of the stringers, in which the upper stringers rest on the lower stringers. Support elements are articulated to the top structure, and an automatic latching apparatus is provided to interconnect the support members with the stringers.

8 Claims, 11 Drawing Figures

APPARATUS SUITABLE FOR USE AS STAIRWAYS, STEPLADDERS AND THE LIKE

BACKGROUND OF THE INVENTION

This invention relates to an apparatus which may take the form of a stairway or pair of steps, the treads of which are always automatically maintained parallel to the ground regardless of the angle of the stringers relative to the ground. In consequence, when the apparatus is brought into a horizontal position, the treads form a substantially continuous plate.

Apparatus is already known which includes treads which are maintained horizontal regardless of the angle of the apparatus, such apparatus being used particularly for gangways connecting harbour quays with floating bridges or launches which are at a lower level than the quays but which are vertically movable with the rising and falling tide. With such apparatus it is not necessary for the treads to form a continuous plate intended for receiving a large load, and for the load to be distributed over substantially the entire length of the two stringers so that one stringer shall rest upon the other.

Ladders are also known, in which the stringers are pivotally mounted relative to a lower tread and a fixed, horizontal upper tread, as are ladders comprising a pair of fixed stringers, relative to which another pair is capable of being spread out or folded in.

SUMMARY OF THE INVENTION

An object of this invention is to provide such apparatus which is perfectly stable when resting upon the ends of the stringers and, when brought to the horizontal, forms a continuous and solid plate.

A further object of the invention is to provide such apparatus in which each of the treads constituting the plate is supported by each of the stringers, the angle of the staircase being variable and not in any way leading to variations in absolute horizontality of the treads.

Accordingly, the invention provides apparatus for use as stairs, steps and the like, comprising a first, lower pair of parallel, rectilinear stringers, a second, upper pair of parallel, rectilinear stringers; each stringer in the lower pair being disposed below and parallel to a respective stringer in the upper pair; a pair of horizontal, parallel arms between which first ends of the stringers are disposed, said first ends of the stringers being articulated to said arms about support arm pivot axes extending between the arms; the support arm pivot axis for the lower stringers being offset downwards by a predetermined vertical distance from the support arm axis for to the upper stringers; a plurality of treads disposed between the stringers; each tread being pivoted to the lower stringers about a first tread pivot axis and to the upper stringers about a second tread pivot axis; the tread pivot axes associated with each stringer being spaced apart longitudinally of the stringer by distances approximately equal comparable to the widths of the treads, each of said treads being provided with at least one downwardly extending member adjacent one edge by way of which member the means of articulation between the tread and each lower stringer is supported, the first and second tread pivot axes for each tread being offset vertically by a distance approximately equal to said predetermined vertical distance between the support arm pivot axes, and more particularly, approximately equal to the sum of the distances, firstly between the upper longitudinal edges of the lower stringers and the support arm pivot axis of those stringers, and secondly between the lower longitudinal edges of the upper stringers and the support arm pivot axis of those stringers, thereby, when the stringers are pivoted relative to the arms the treads remain horizontal, and the lower longitudinal edge of each upper stringer rests upon the upper longitudinal edge of the respective lower stringer when the stringers are disposed horizontally.

In the practical embodiment to be described herein, the spacing between the pivot axes along the stringers is slightly greater than the widths of the treads.

The pivotal tread connection between each tread and the stringers can be achieved in two preferred ways; either by the use of two tubes integrally attached to each tread and slid onto bars fixed between the stringers, the treads carrying perpendicular, underlying, longitudinal flanges bearing against the tubes; or alternatively by the provision on the treads of perpendicular lateral flanges, through which there pass rods fixed to each stringer.

The apparatus may alternatively be arranged so that it may be used as a pair of steps, from which condition it may be collapsed to form a wheeled structure suitable for use as a truck, trolley or barrow.

DESCRIPTION OF THE PREFERRED EMBODIMENT

Figure 1:
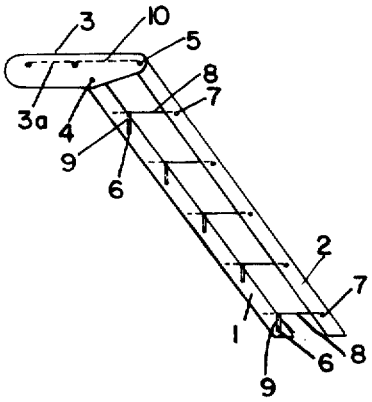
FIG. 1 is a partial, diagrammatic side view of apparatus embodying the invention in an inclined position.
Figure 2:
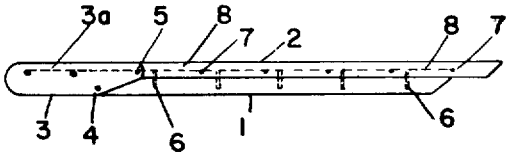
FIG. 2 is a view in the same direction as FIG. 1, but showing the apparatus in the horizontal position.

Referring to FIGS. 1 and 2, apparatus in accordance with the invention may be made to occupy either an inclined position (FIG. 1) in which it serves as a flight of stairs, or a horizontal position in which it serves as a gangplank, or the like. In the inclined position a series of treads 8 are in vertically spaced arrangement, whereas in the horizontal position the treads are juxtaposed or are separated by small gaps.

In these figures, parts of the apparatus have been depicted diagrammatically. Essentially the apparatus comprises a main frame consisting of a pair of spaced apart lower stringers 1, a pair of spaced apart upper stringers 2 and a pair of spaced apart support members or arms 3, to each of which one stringer 1 and one stringer 2 are pivoted for movement about support arm pivot axes 4 and 5. Only one of each of the parts 1 to 3 is visible in FIGS. 1 and 2, the other ones of these parts being obscured from view.

The treads 8 occupy positions between the two pairs of stringers, each tread being articulated to the lower stringers about tread pivot axes 6 and to the upper stringers about tread pivot axes 7. Each tread is pivoted to the lower stringers by way of blocks or spacers 9.

A fixed tread 3a is depicted as being provided between the arms 3 but this tread may be omitted in suitable circumstances.

The support arm pivot axes or axes of rotation 4 and 5 lie in respective horizontal planes spaced by a predetermined vertical distance equal to the distance between horizontal planes in which lie the tread pivot axes 6 and 7 of each tread 8. This spacing is also equal to the width of each of the stringers 1 or 2 in the case where these stringers are identical and where the centres of the pivot axes 6 and 7 lie on the median longitudinal lines of the stringers 1 and 2, respectively. This spacing is also equal to the height of the block or spacer 9.

Figure 3:
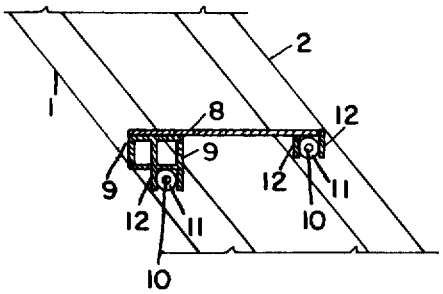
FIG. 3 is a partial longitudinal section through the apparatus showing a first arrangement for fixing a tread to the stringers.
Figure 4:
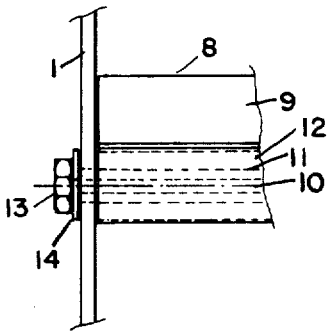
FIG. 4 is a view to an enlarged scale, looking from the left of FIG. 3.

FIGS. 3 and 4 show one arrangement for mounting the treads 8 between the stringers, in which the tread pivot axes are provided by rods 10 which extend between the stringers and are held in place by nuts 13 screwed onto the ends of the rods and bearing against the stringers through washers 14. Each rod carries a tube 11 held fast with the associated tread by flanges 12 embracing the tube. The flanges 12 associated with the upper stringers depend directly from the tread. The other flanges are formed on spacer or block 9 to offset these flanges in a vertical sense by the desired distance.

Figure 5:
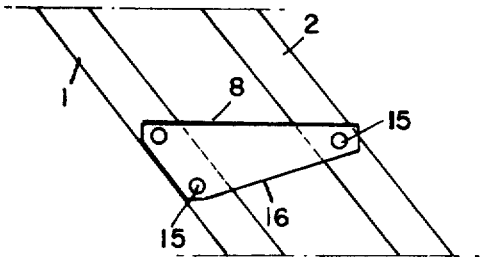
FIG. 5 is a view similar to FIG. 3 showing a second arrangement for fixing a tread to the stringers.
Figure 6:
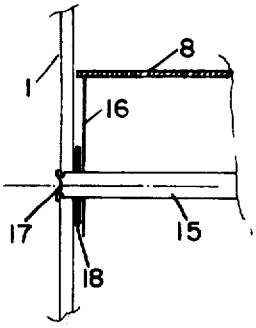
FIG. 6 is a view similar to FIG. 4 but showing the parts in FIG. 5.

Referring now to FIGS. 5 and 6, a second arrangement for mounting the treads 8 to pivot about tread pivot axes is achieved by forming or providing each tread with a depending flange or wall 16 at each end. Rods 15 located in appropriate positions having regard to the amount of offset to be obtained extend between the respective stringers and through the walls 16. The ends of the rods are made rigid with the outer sides of the stringers, conveniently by upsetting using a rivetting tool for aesthetic reasons. The ends of the rods are thinned down so that only the part 17 passes through the stringers and there is obtained a double blocking of the stringers 1 and 2 on the rods 15.

A washer 18 prevents frictional contact of the walls 16 with the stringers 1 and 2. These walls 16, as can best be seen in FIG. 5, are of a sufficient height to permit the pivot axis of the rod 15 of the stringer 1 to be offset relative to the pivot axis of the rod 15 or the other stringer 2.

Figure 8:
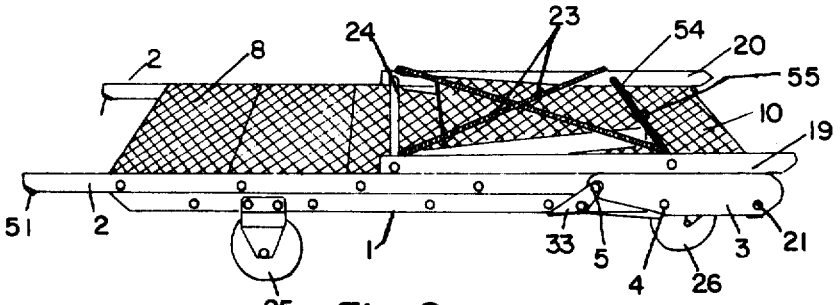
FIG. 8 is a view to an enlarged scale showing the apparatus of FIG. 7 in a collapsed condition in which the apparatus forms a hand truck.

In order to hold the apparatus in the erected condition it is equipped with elongate support members formed of two bars 19, 20 of flat or profiled section articulated between the horizontal arms. A support bar pivot axis 21 of the support members or bars is provided between the arms 3, which axis does not intersect the median line of these elongate support members 19 and 20, but is off-set from these members each of these members being provided with a posts 22 (FIGS. 9, 10, 11) which carry the pivot rod so that the support members 19, 20 can swing from an upright position below the horizontal arms 3 (FIG. 7) to a rest position, above and parallel to the horizontal arms 3 (FIG. 8).

Between the support members 19, 20, which will act as guide arms for the carriage, there are mounted a cross-bracing 23 and a transverse member 24 perpendicularly to the support members 19 and 20. The transverse member 24 may be a tube which serves for pushing or pulling the apparatus when in its collapsed, truck-forming condition.

In this collapsed condition fixed wheels 25 mounted in brackets fixed upon the lower stringers 1, and steering wheels 26 mounted (by means not shown) in known manner below the fixed tread 10 make contact with the ground.

Figure 9:
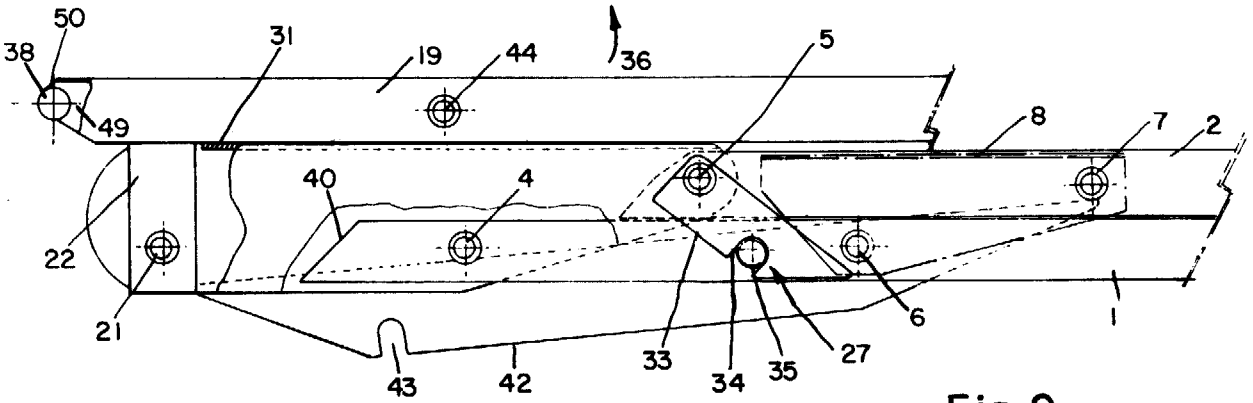
FIG. 9 is a side view of latching mechanism for the apparatus shown in FIGS. 7 and 8 in the position occupied by the mechanism when the apparatus is in its collapsed condition.
Figure 10:
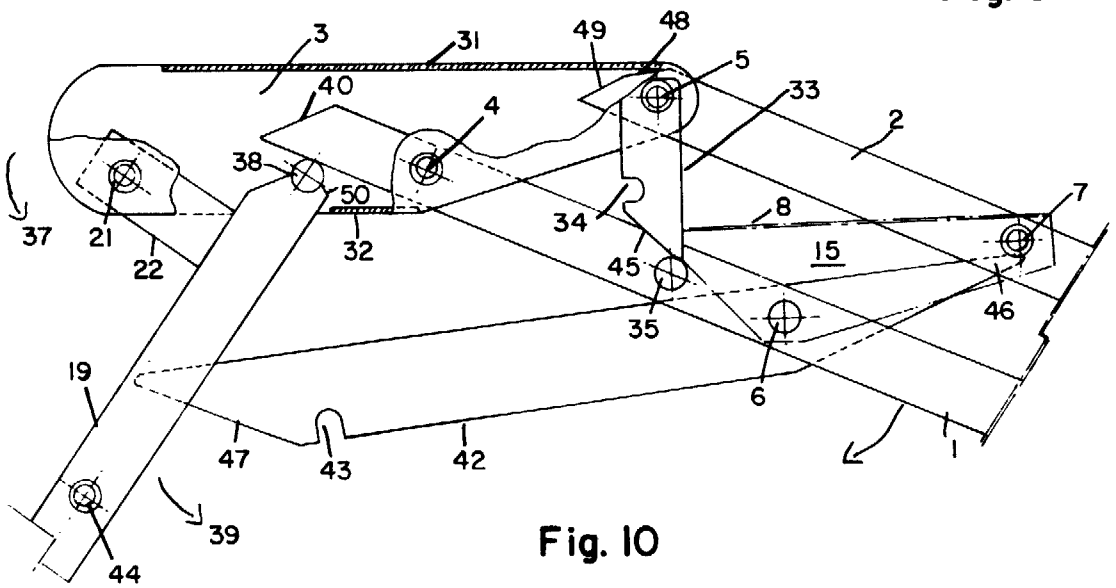
FIG. 10 shows the mechanism of FIG. 9 in the position it occupies when the apparatus is in a position intermediate its collapsed and erected conditions.
Figure 11:
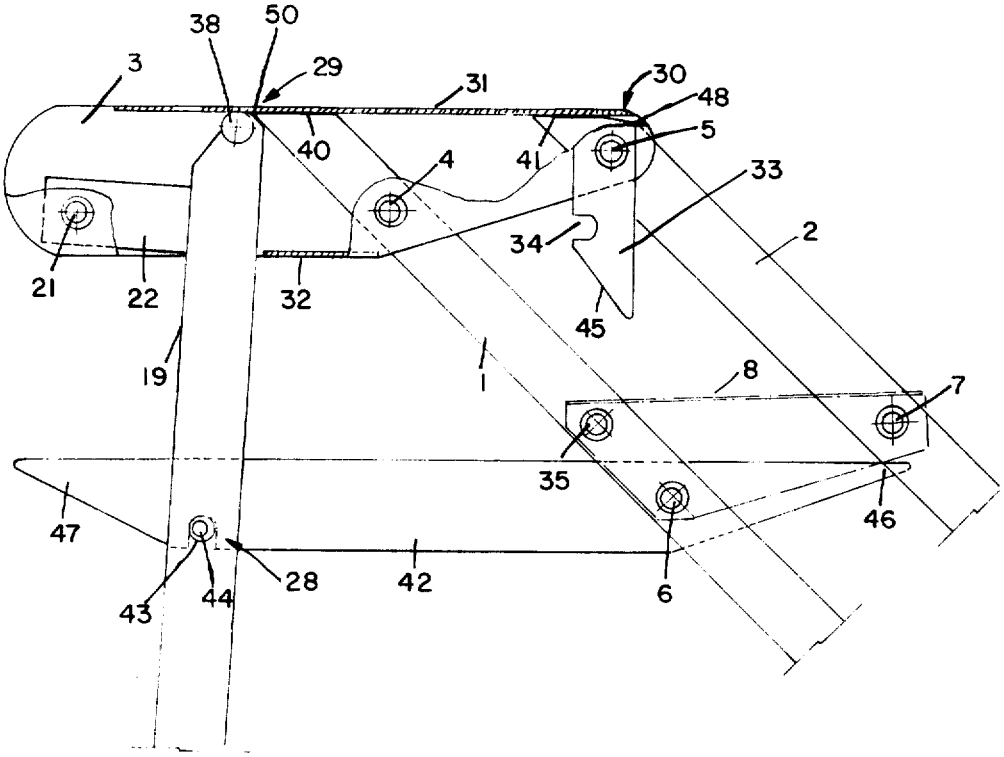
FIG. 11 shows the mechanism in the position corresponding to the erected condition of the apparatus.

When the apparatus is erected, i.e. set in its step-ladder forming condition, it is necessary to ensure that the stringers and support members maintain a given angle there between. To this end, a latching system is provided which can take any suitable form but which is preferably as shown in FIGS. 9 to 11, where there are provided four latching or blocking points, which are indicated by arrows 27 (FIG. 9), 28, 29, 30 (FIG. 11).

As shown in these Figures, a top step unit is formed by the horizontal arms 3 these arms again interconnected by a tread or cross-member similar to tread 3a but shown here as comprising an upper plate 31 rigidly mounted on and extending between arms 3, and below which are mounted the pivots or spindles 4, 5 on which the stringers 1 and 2 are supported, and also the pivot, bar or spindle 21 for support members 19 or 20. Below the plate 31, arms 3 are interconnected by a plate 32, FIGS. 10 and 11, which is narrower, so that it, as shown, will not interfere with pivoting motions of the stringers.

In the collapsed or carriage forming or rest position (FIG. 9) each lower stringer 1 is held to the pertaining upper stringer 2 by a latch 33 having a notch 34 in which is received a stop 35 projecting from the side of the stringer. It is not essential for this latching point (denoted by arrow 27) to be provided but it has the advantage of preventing lifting of the opposite end of the top step unit when a heavy pressure is applied to the other end of said unit by the support members 19, 20, particularly when the apparatus is used as a trolley or barrow and more especially when it is not loaded.

When the support members 19, 20 (FIG. 8) are swung up in the direction of arrow 36 (FIG. 9), they may be used as guide arms for the trolley formed by the apparatus. By then releasing the latch 33 and continuing the rotational movement of the support members 19, 20 in the direction of arrow 37 (FIG. 10), a roller 38 which interconnects the ends of these support members will come to bear against the lower stringers 1 and tend to turn them into an upright position (FIG. 10). This movement also results in the upper stringer being similarly turned. By still continuing to turn or rotate the support members 19 and 20 in the direction of arrow 39, the set-up position shown in FIG. 11 is reached, in which the roller 38 bears and is stopped by against the underside of the horizontal part 31 of the top step unit (as shown at 29) as do the ends 40 of the lower stringers 1 (as shown at 29) and the ends 41 of the upper stringers (as shown at 30). As soon as this stopping position is reached, further turning or rotation is prevented so that a position cannot be reached in which there is an angle between the stringers and support members, smaller than the illustrated angle which is defined by this stopping of the support elements and stringers, as shown.

The prevent re-opening of the apparatus, there is provided, preferably on each side, a latching arm 42 which is fixed to the side of a respective one of the underlying stringers 1. The arm 42 has a notch 43 which fits over a stop or pin 44 projecting from the internal face of a respective support member 19 or 20, so as to constitute a further latching point (shown at 28, FIG. 11).

In order that the above described blocking and latching actions shall be automatic, the end 45 of the latch 33 is chamfered and the latch is hinged to pivot freely about the spindle 4. When the steps are being returned to the collapsed position, the end 45 will slide upon the stop 35 when a predetermined position has been reached (FIG. 10), so that later in the collapsed position (FIG. 9) the notch 34 will lie opposite the stop 35 so that the latch falls over the stop, unblocking being carried out automatically as indicated above.

Similarly, the notch 43 is arranged to automatically receive the stop 44. The ensure this, the blocking arm 42, which pivots freely about a pivot spindle 6 of the lower stringer 1, extends beyond this spindle as far as the spindle 7 of the upper stringer 2, so that its end 46 abuts this spindle 7 (FIGS. 9 and 10) and so that the blocking arm 42 cannot fall into the vertical position but, on the contrary, will be maintained approximately horizontal, so that the chamfered end 47 of this arm, once a predetermined angle between the parts has been reached (exceeding that shown in FIG. 10) will abut against the stop 44 and finally the notch 43 will fall onto the stop 44.

Unblocking will not however be automatic but will be caused by raising the blocking arm or arms 42.

As can be seen in FIG. 11, the ends 40 and 41 of the stringers 1 and 2 are also cut to a chamfer, to an angle determined so that they abut solidly against the internal face of the cross-member 31 of the top step unit. Nevertheless, to permit rotation of the upper stringers 2, it is necessary to provide a second cut-away portion 48 at the end 41 of these stringers. The same is true also for the end 49 of the support members 19 and 20, which must have a chamfered cut-away portion 50 so that it does not abut against the underlying stringers 1.

To enable the steps to be easily moved while still erected two small rollers 51 (FIG. 7) are provided at the lower ends of the upper stringers 2, so that, by slightly raising the steps by the top step unit it is possible to roll them along.

If, in addition, it is desired to use the steps as a bench, the upper cross-member or tread 10 serving as a work table, it is preferable to equip the steps with a folding foot-rest platform 52, on which the workman can stand so as to stabilise the steps with his weight. This platform 52 may, for example, be pivotally mounted by arms 53 on the transverse member 24.

In order to retain this platform when the apparatus is in the collapsed position, it is possible to provide a supplementary transverse member 54 (FIG. 8) between the support members 19, 20. A hooking strip 55 attached to the end of the platform 52 can then engage this transverse member 54; the transverse member 54 can also act as the stop 44.

Figure 7:
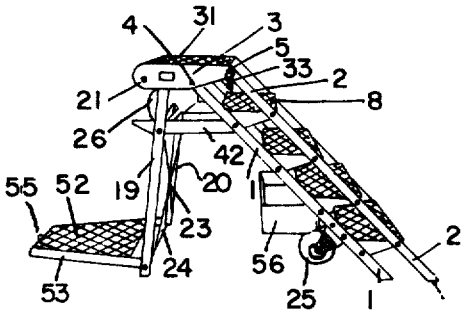
FIG. 7 is a perspective view, more complete than FIGS. 1 and 2 and looking from the side, of apparatus embodying the invention, in an erected condition.

When the steps are used as a bench, it is also possible to provide, as shown in FIG. 7, a tray 56 serving for setting out tools, and mounted on the pivot axes 6 of the lower stringers 1, so that, like the treads 8, the tray 56 is maintained horizontal whatever the position of the stringers 1.

Although it is not in any way necessary to provide blocking for the support members 19, 20 or for the underlying stringers 1, these being absolutely prevented from continuing their rotation in the erected position (see arrow 29), the width of the lower horizontal part 32 of the top step unit 3 can also be such that, as shown in FIG. 11, both the support members 19, 20 and also the lower stringers 1 abut against the opposite ends of this horizontal part.

The invention is of course not limited to the specific embodiments described and shown, and modifications may be made. In particular, the blocking system may be altered and accessories other than the rollers 51, foot-rest platform 52, and tool tray 56 may be provided. Attachment means (such as notches, screw threads or the like) may also be provided for one or more extension platforms, or for a vise.

Moreover, although the apparatus can be made of any suitable material, it is preferably constructed of aluminium sections, enabling an extremely light device to be obtained having a very pleasing appearance. In this sense also, the connecting means, as can be seen in FIG. 8, are essentially for the various points of fixing, pivots, and axes of rotation, in the form of rivets flattened by a riveting die. In addition, the various axes of rotation and pivoting which require the use of washers are concealed either by the external face of the horizontal arms 3, or by the lateral sides 15.

Of course, it will be appreciated that any other suitable top structure may be used in place of the arms 3, the only requirements for such structures being that the stringers (and if necessary, support members) can be connected to it with appropriate amounts of offset.

What is claimed is:

1. Apparatus for use as stairs, steps and the like, comprising;

lower and upper pairs of parallel rectilinear stringers, each stringer of the lower pair being disposed below and parallel to the respective stringer of the upper pair;

a pair of horizontal, parallel arms whereto first ends of the stringers are articulated about respective arms pivot axes extending between the arms, one of said axes supporting the lower stringers and being spaced downwardly from another one of the arm pivot axes, said other one supporting the upper stringers;

a plurality of treads mounted on and between the stringers, each tread having lower tread pivot means connecting it to the lower stringers at and about a lower tread pivot axis, and each tread having upper tread pivot means connecting it to the upper stringers at and about an upper tread pivot axis, the tread pivot axes being spaced apart longitudinally of the stringers by distances approximately equal to the widths of the treads and being spaced apart vertically by a distance approximately equal to said predetermined vertical distance between the arm pivot axes; and two elongate support elements articulated between the horizontal arms, each such element having a post perpendicular thereto and having post pivot means pivoted to one of the horizontal arms so that the support elements can be turned from a support position below the horizontal arms to a rest position above the horizontal arms; whereby the stringers and the support elements can be turned relative to the horizontal arms, while the treads are and remain horizontal.

2. Apparatus according to claim 1, including roller means mounted on the elongate support elements, adjacent the horizontal arms, for abutting, upon the turning of the support elements, against the lower stringers to effect the turning of the stringers;

3. Apparatus according to claim 1, also including a cross-member rigidly mounted on and extending between the horizontal arms above the stringers and support elements and located so as to stop the turning of the stringers and of the support elements when they have been turned from a rest position thereof parallel to the arms and to one another into a set-up position in which they define a predetermined angle between the support elements and the stringers.

4. Apparatus according to claim 1, also including a blocking arm pivoted to one of the lower stringers for reversible, latching engagement with the corresponding support element when the stringers and support elements have been turned from a rest position thereof, parallel to the horizontal arms and to one another, into a set-up position in which they, jointly with the treads, provide a step ladder.

5. Apparatus according to claim 4 in which the pivoting of the blocking arm is effected at and by one of the lower tread pivot means.

6. Apparatus according to claim 5 in which the pivoted blocking arm defines a notch and the corresponding support element has a stop pin, located so that the latching engagement of the arm with the support element is automatically effected by engagement of the stop pin with the notch, subject to manual disengagement of the arm from the support element.

7. Apparatus according to claim 6 in which the blocking arm has a first end portion disposed adjacent the corresponding tread pivot axis, said portion contacting the corresponding upper stringer so as to hold the arm in approximately horizontal position when the stringers are turned toward the set-up position, the arm having a second and chamfered end portion remote from the first end portion for cooperating with the stop pin to guide the arm into said latching engagement in the set-up position of the stringers and support elements.

8. Apparatus according to claim 1, including a footrest platform mounted between the support elements and foldable into and between a horizontal position of the platform, at an angle to said elements in their set-up position, and a horizontal position of the platform, parallel to said elements in their rest position.

* * * * *